US007411561B1

(12) United States Patent
Baldauf et al.

(10) Patent No.: US 7,411,561 B1
(45) Date of Patent: Aug. 12, 2008

(54) GIMBALED DRAGONIAN ANTENNA

(75) Inventors: John E. Baldauf, Redondo Beach, CA (US); Eric D. Lee, Sherman Oaks, CA (US); Brian M. Park, Torrance, CA (US); Joel R. Dixon, Torrance, CA (US)

(73) Assignee: The Boeing Company, Chicago, IL (US)

( * ) Notice: Subject to any disclaimer, the term of this patent is extended or adjusted under 35 U.S.C. 154(b) by 132 days.

(21) Appl. No.: 11/394,032

(22) Filed: Mar. 30, 2006

Related U.S. Application Data

(60) Provisional application No. 60/675,146, filed on Apr. 27, 2005.

(51) Int. Cl.
*H01Q 13/00* (2006.01)

(52) U.S. Cl. ..... 343/781 P; 343/761; 343/781 CA

(58) Field of Classification Search ..... 343/765, 343/781 CA, 781 P, 705, 708, 757, 761
See application file for complete search history.

(56) References Cited

U.S. PATENT DOCUMENTS

| | | | | |
|---|---|---|---|---|
| 4,284,992 | A * | 8/1981 | Gans | 343/909 |
| 4,339,757 | A * | 7/1982 | Chu | 343/781 P |
| 4,491,848 | A * | 1/1985 | Dragone | 343/781 P |
| 6,492,955 | B1 * | 12/2002 | Amyotte et al. | 343/781 P |
| 6,965,351 | B1 * | 11/2005 | Miller et al. | 343/781 P |
| 7,161,549 | B1 * | 1/2007 | Cuchanski et al. | 343/781 CA |
| 2003/0214451 | A1 * | 11/2003 | Mizuno et al. | 343/781 P |
| 2005/0219138 | A1 * | 10/2005 | Obert et al. | 343/781 P |

* cited by examiner

*Primary Examiner*—Tan Ho
(74) *Attorney, Agent, or Firm*—Jonathan W. Hallman; MacPherson Kwok Chen & Heid LLP

(57) ABSTRACT

In one embodiment, a gimbaled reflector antenna is provided that includes: a Dragonian antenna having a sub-reflector and a main reflector; a feed; a third reflector adapted to reflect a beam from the feed to the sub reflector; an azimuth gimbal adapted to rotate the Dragonian antenna with respect to the third reflector; and an elevation gimbal adapted to rotate the flat reflector with respect to the feed.

22 Claims, 6 Drawing Sheets

GIMBALED DRAGONIAN ANTENNA

RELATED APPLICATIONS

This patent application claims the benefit of U.S. Provisional Patent Application No. 60/675,146, filed on Apr. 27, 2005 and entitled GIMBALED DRAGONIAN ANTENNA. The entire contents of this provisional patent application are hereby expressly incorporated by reference.

STATEMENT REGARDING FEDERALLY SPONSORED RESEARCH OR DEVELOPMENT

This invention was made with Government support under contract number FA8808-04-C-0022 awarded by the U.S. Air Force. The Government has certain rights in this invention.

TECHNICAL FIELD

This invention relates to antennas, and more particularly to a gimbaled reflector antenna.

BACKGROUND

Gimbaled reflector antennas provide a high gain signal path over a wide field of regard extending beyond the beam width of a fixed antenna of equivalent design. This high gain signal path is provided by mechanically steering the beam to a desired location through appropriate actuation of the associated gimbals. In this fashion, a gimbaled reflector antenna may be used to track moving targets regardless of whether the antenna position itself is also changing. Gimbaled reflector antennas may also perform sequential acquisition of multiple targets at multiple positions or be used to move a fixed set of multiple beams to different locations. Thus, gimbaled reflector antennas have numerous applications in both wireless communication systems and sensor systems.

As illustrated in FIG. 1, a conventional gimbaled reflector antenna system 100 having a large field of regard requires an antenna feed 105 and a reflector 110 to remain fixed with respect to each other to minimize gain performance degradation. Because of their fixed spatial relationship, feed 105 and reflector 110 must move in tandem. Thus, to accommodate scanning of reflector antenna system 100 requires either a rotating or a flexible electrical connection 120 to carry signals to feed 105. Typical systems use rotary joints or slip rings or flexible cables with large service loops. To minimize RF front end losses, a low noise amplifier (LNA) 130 should placed as close are possible to feed 105, often requiring it to move with the feed. The addition of LNA(s) 130, associated power supplies, and thermal control features introduce extra gimbaled mass that complicates the electrical and mechanical design of system 100.

To eliminate the complications associated with a fixed feed/reflector design, one current approach is to use what is called a "beam waveguide" that eliminates "hard" electrical connections (connection made with cables, waveguide, or other physical media such as flexible electrical connection 120) through the gimbals of a reflector system. A beam waveguide is a multiple reflector system that produces an image of the feed that is displaced from where the feed is physically located. This feed image orientation can be changed by rotation of one or more of the beam waveguide reflectors. This image of the feed is then used to feed a focused reflector system, producing the high gain spot pattern. Conventional beam waveguide systems require four or five reflectors in addition to two reflectors for the final focused main reflector. This large number of reflectors requires complicated design, assembly, and alignment procedures. For electrically small antenna systems, this may be impractical.

Another approach to providing large field of regard is to use a phased array antenna. Phased array antennas require small element spacing for large scan angles, resulting in a large number of elements for a given gain requirement. In addition, it difficult to produce an array that looks over a spherical field of regard or multiple arrays. Moreover, the number of active electronic devices such as amplifiers and phase shifters typically make the cost prohibitive.

Accordingly, there is a need in the art for improved gimbaled reflector antenna systems that provide a large field of regard.

BRIEF SUMMARY

In one exemplary embodiment, a gimbaled reflector antenna is provided that includes: a Dragonian antenna having a sub-reflector and a main reflector; a feed; a third reflector adapted to reflect a beam from the feed to the sub-reflector; an azimuth gimbal adapted to rotate the Dragonian antenna with respect to the third reflector; and an elevation gimbal adapted to rotate the flat reflector with respect to the feed.

In another exemplary embodiment, a method of transmitting an RF signal using a Dragonian antenna having a sub-reflector and a main reflector is provided that includes: transmitting the RF signal from a source to a first reflector; reflecting the RF signal from the first reflector to the sub-reflector; reflecting the RF signal from the sub-reflector to the main reflector; and reflecting the RF signal from the main reflector to form a transmitted RF beam.

A better understanding of the above and many other features and advantages of the present invention may be obtained from a consideration of the detailed description of the exemplary embodiments thereof below, particularly if such consideration is made in conjunction with the appended drawings, wherein like reference numerals are used to identify like elements illustrated in one or more of the figures therein.

DETAILED DESCRIPTION

Figure 1:
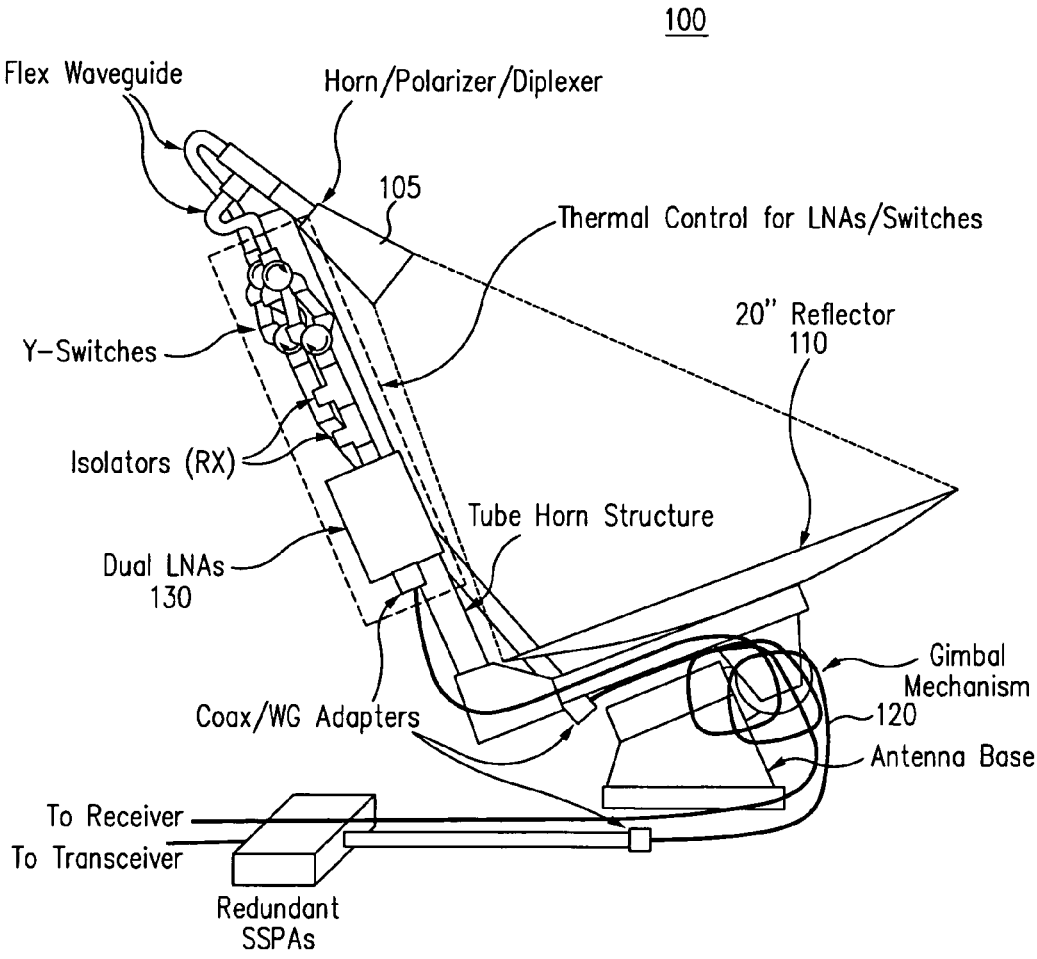
FIG. 1 (PRIOR ART)
FIG. 1 is a side elevation view of a conventional gimbaled reflector antenna system.
Figure 2:
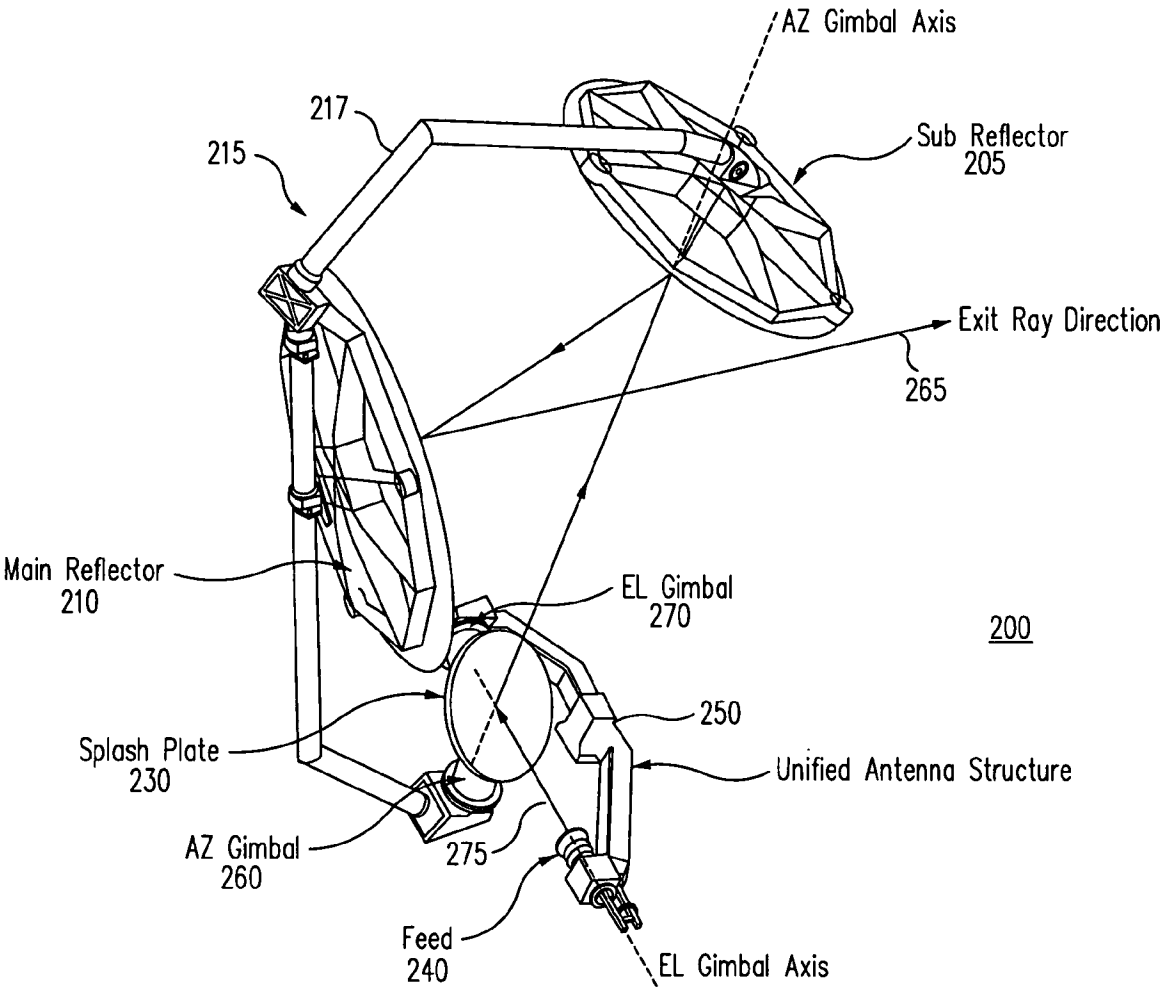
FIG. 2 is an isometric view of a gimbaled reflector antenna system in accordance with an embodiment of the invention.

To avoid the aforementioned problems in the prior art, a beam waveguide gimbaled reflector antenna is provided that includes as few as three mirror elements. Turning now to FIG. 2, an isometric view of an exemplary embodiment of a beam waveguide gimbaled reflector antenna 200 is illustrated. A hyperbolic sub-reflector 205 and a parabolic main reflector 210 form a Dragonian antenna sub-system 215 supported by a frame 217. As known in the art, Dragonian antennas are also referred to as side-fed offset Cassegrain antennas. A flat plate (splash plate) reflector 230 (reflects an RF beam from a feed such as a feed horn 240 towards sub-reflector 205.

Figure 3:
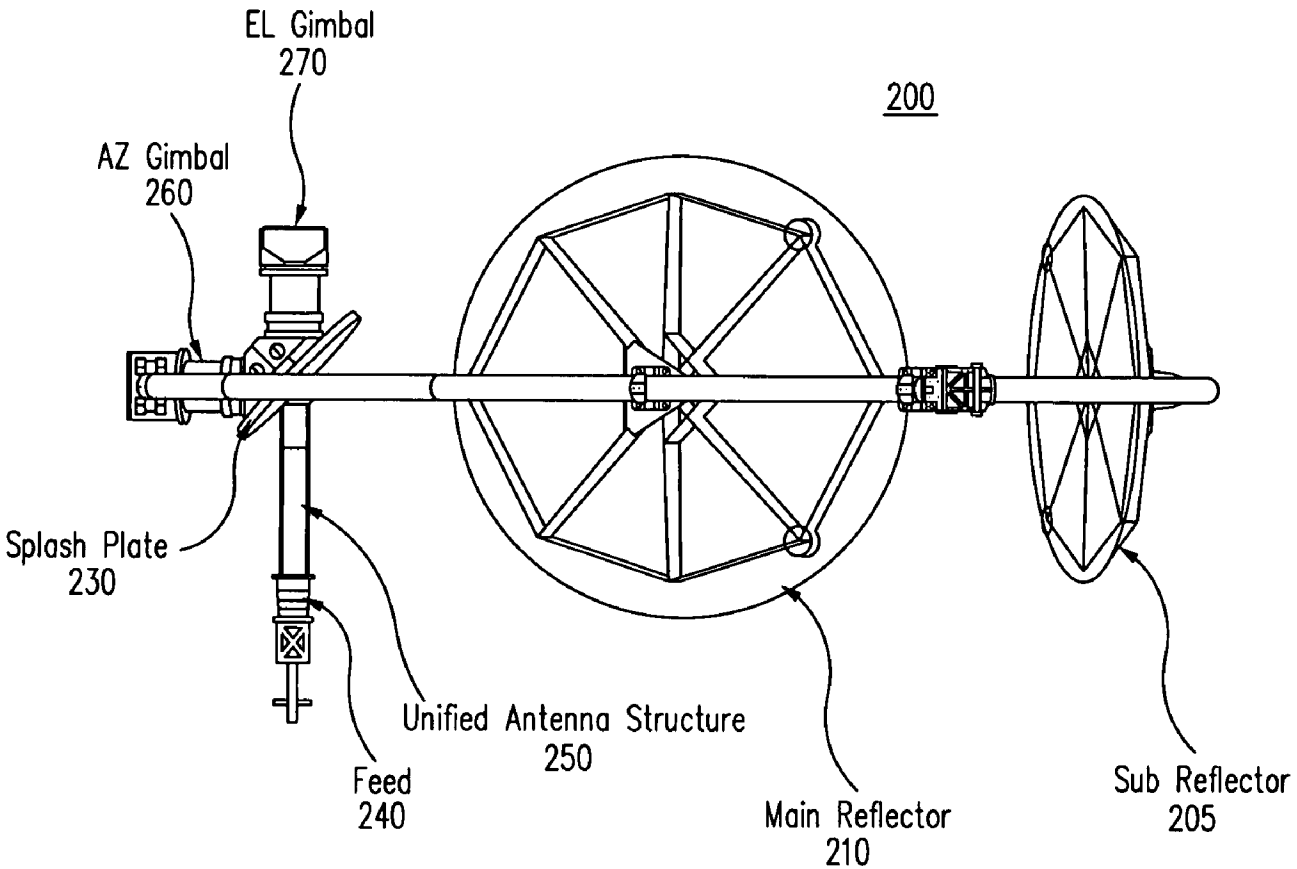
FIG. 3 is a back view of the gimbaled reflector antenna system of FIG. 2.
Figure 4:
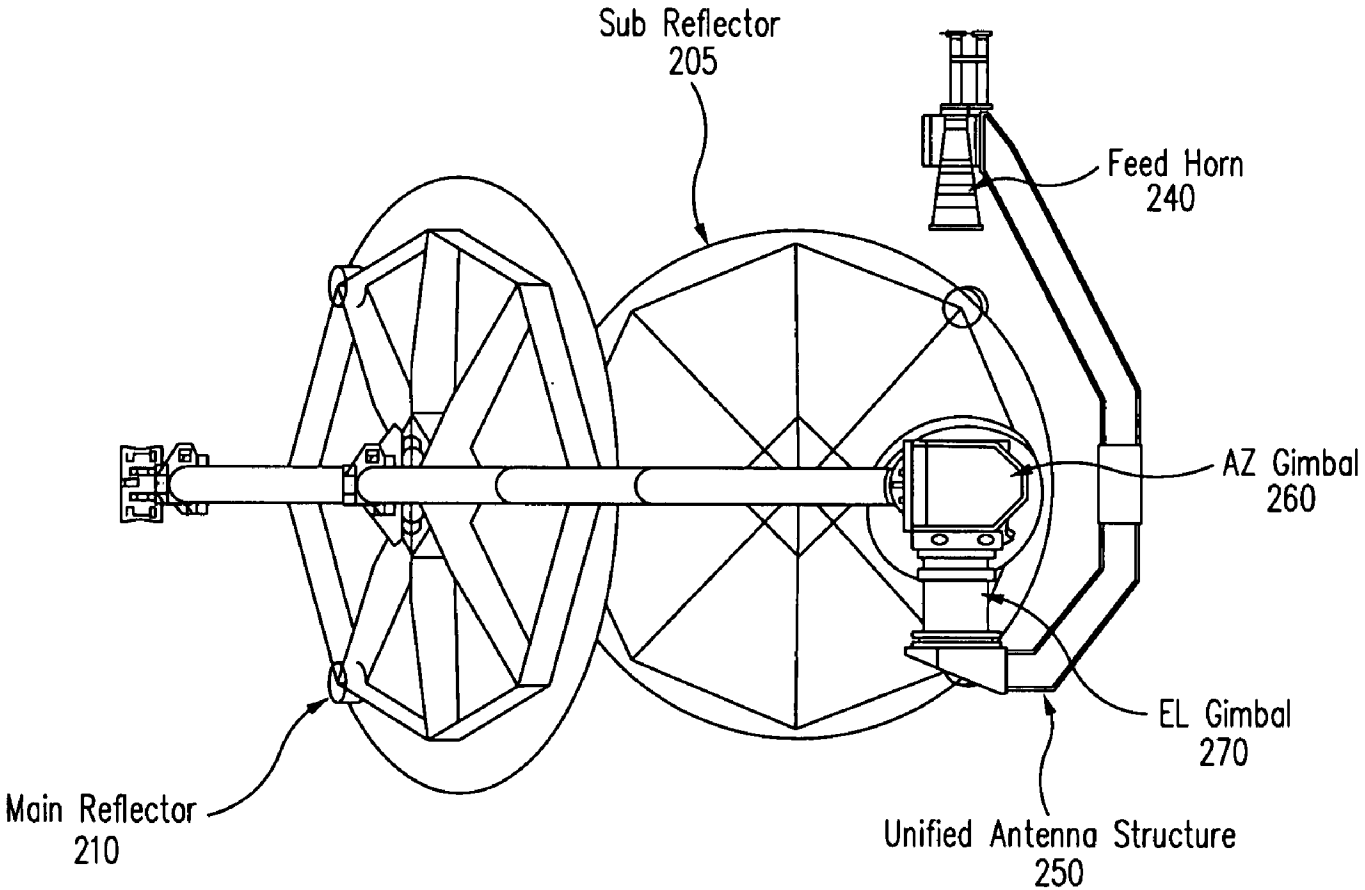
FIG. 4 is a bottom view of the gimbaled reflector antenna system of FIG. 2.
Figure 5:
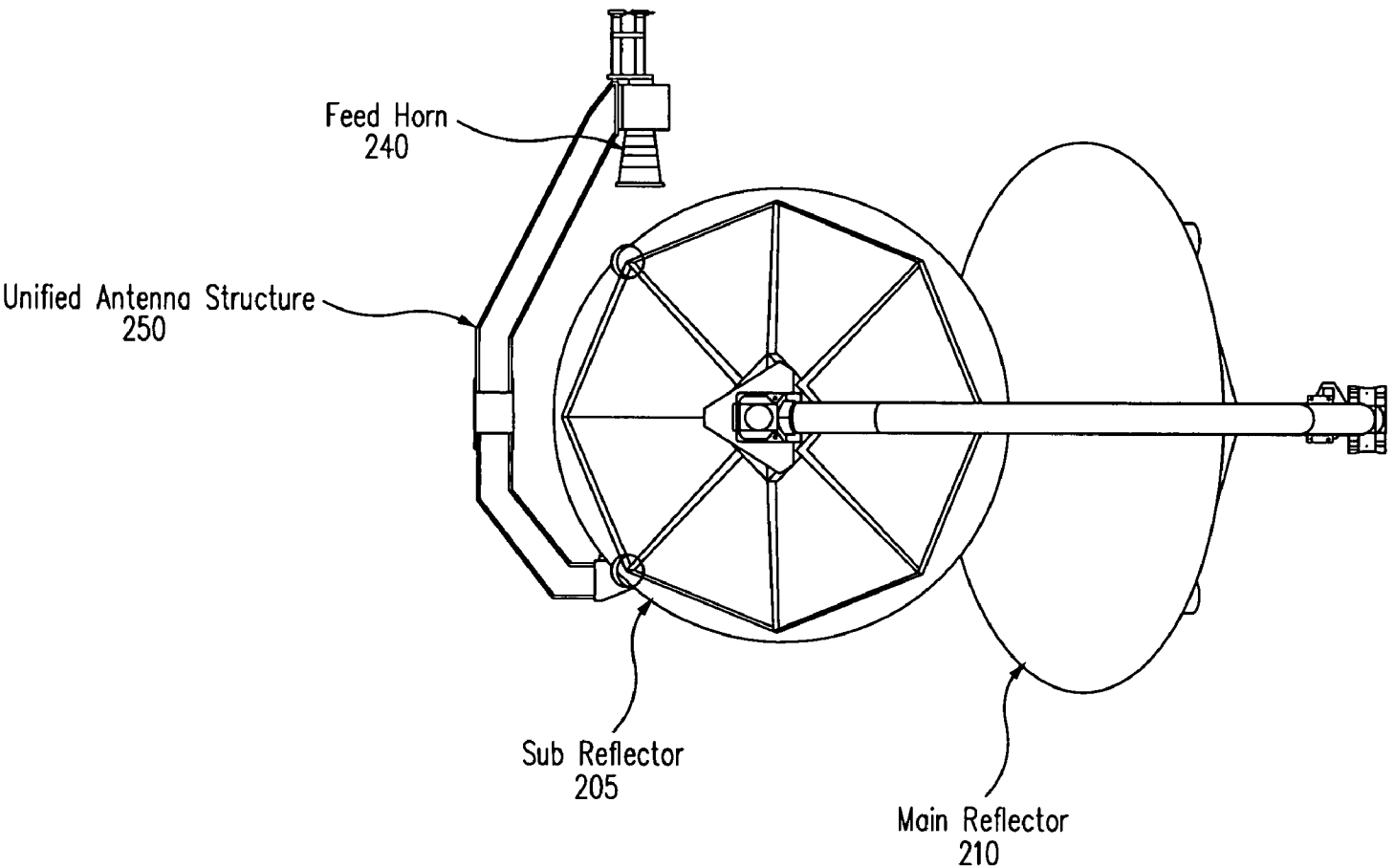
FIG. 5 is a top view of the gimbaled reflector antenna system of FIG. 2.
Figure 6:
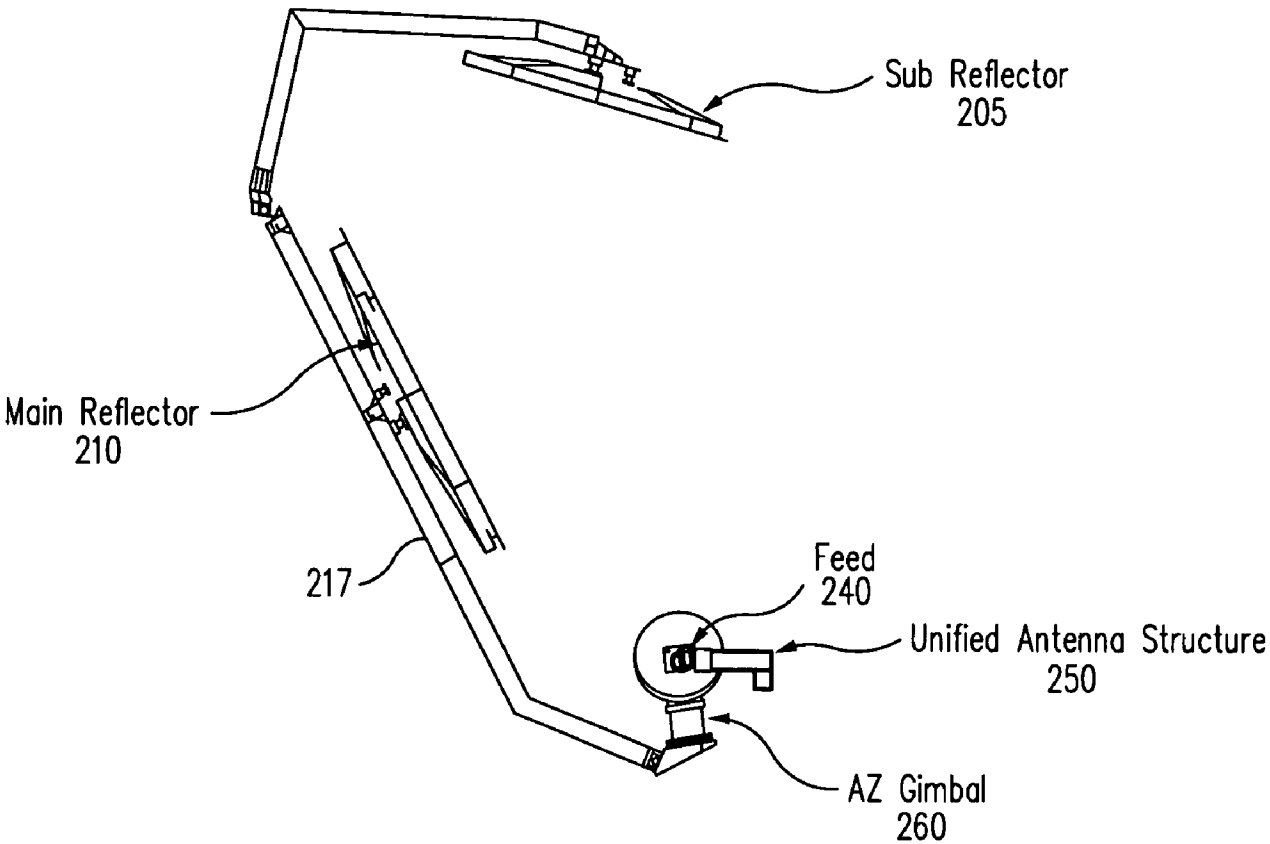
FIG. 6 is a side view of the gimbaled reflector antenna system of FIG. 2.

Feed horn 240 mounts on an antenna structure 250 that forms the mounting reference for antenna 200. For example, in a space-based application, antenna structure 250 would be mounted to the spacecraft. Frame 217 for Dragonian antenna sub-system 215 mounts to an azimuth gimbal 260 that is also coupled to flat reflector 230. The spatial relationship of these components may also be seen in the back view of FIG. 3, the bottom view of FIG. 4, the top view of FIG. 5, and the side view of FIG. 6. Given such a structure, an exit beam 265 from main reflector 210 may be scanned as follows. Azimuth gimbal 260 is actuated to rotate Dragonian antenna sub-system 215 with respect to flat plate 230. By rotating Dragonian antenna sub-system 215 through 360 degrees (subject to any mechanical interferences), a complete azimuth scan is achieved.

An elevational scan of exit beam 265 is achieved as follows. An elevation gimbal 270 rotates flat plate 230 about a firing line axis 275 from feed horn 240 with respect to antenna structure 250. In turn, this rotation of flat plate 230 also rotates Dragonian antenna sub-system 215 such that exit beam 265 is scanned in the elevational plane.

Advantageously, the image of the feed in main reflector 210 does not change provided that the feed radiation to sub-reflector 205 is symmetrical about the azimuth gimbal axis, regardless of the rotations of azimuth gimbal 260 and elevation gimbal 270. Thus, the antenna performance is unperturbed as antenna 200 is scanned to a desired azimuth and elevation location, provided that surrounding structure to which antenna structure 250 mounts to does not electrically interfere with exit beam 265. In this fashion, hemispherical fields of regard may be achieved with no degradation in antenna performance with just three reflectors. In addition, because the gimbaled mass is reduced through the use of just three reflectors, light weight gimbals may be used, further decreasing the overall mass.

By now, those of skill in this art will appreciate that many modifications, substitutions and variations can be made in and to the materials, apparatus, configurations and methods of implementing the linear actuators of the present invention without departing from its spirit and scope. Accordingly, the scope of the present invention should not be limited to the particular embodiments illustrated and described herein, as they are merely exemplary in nature, but rather, should be fully commensurate with that of the claims appended hereafter and their functional equivalents.

What is claimed is:

1. A gimbaled reflector antenna, comprising:

a Dragonian antenna having a sub-reflector and a main reflector;

a feed;

a third reflector adapted to reflect a beam from the feed to the sub-reflector;

an azimuth gimbal adapted to rotate the Dragonian antenna with respect to the third reflector; and an elevation gimbal adapted to rotate the third reflector with respect to the feed.

2. The gimbaled reflector antenna of claim 1, wherein the sub-reflector is a hyperbolic sub-reflector.

3. The gimbaled reflector antenna of claim 1, wherein the main reflector is a parabolic reflector.

4. The gimbaled reflector antenna of claim 1, wherein the third reflector is a flat reflector.

5. The gimbaled reflector antenna of claim 1, further comprising a frame connecting the feed to the elevation gimbal.

6. The gimbaled reflector antenna of claim 5, wherein the frame is connected to a spacecraft.

7. The gimbaled reflector antenna of claim 1, wherein the feed is a feed horn.

8. A gimbaled reflector antenna, comprising:

side-fed offset Cassegrain antenna having a sub-reflector and a main reflector;

a feed;

a third reflector adapted to reflect a beam from the feed to the sub reflector;

means for rotating the side-fed offset Cassegrain antenna with respect to the third reflector such that an exit beam from the main reflector scans in an azimuthal direction; and means for rotating the third reflector with respect to the feed such that the exit beam from the main reflector scans in the elevational direction.

9. The gimbaled reflector antenna of claim 8, wherein the sub-reflector is a hyperbolic sub-reflector.

10. The gimbaled reflector antenna of claim 8, wherein the main reflector is a parabolic reflector.

11. The gimbaled reflector antenna of claim 8, wherein the third reflector is a flat reflector.

12. The gimbaled reflector antenna of claim 8, further comprising a frame connecting the feed to the means for rotating the third reflector.

13. A method of transmitting an RF signal using a Dragonian antenna having a sub-reflector and a main reflector, comprising:

transmitting the RF signal from a source to a first reflector;

reflecting the RF signal from the first reflector to the sub-reflector;

reflecting the RF signal from the sub-reflector to the main reflector; and reflecting the RF signal from the main reflector to form a transmitted RF beam; and rotating the Dragonian antenna about an azimuth axis passing through the first reflector to scan the transmitted RF beam in an azimuth direction.

14. The method of claim 13, wherein the rotation is such that the transmitted RF beam is scanned through a hemispherical field of regard in the azimuth direction.

15. The method of claim 13, wherein the sub-reflector is a hyperbolic sub-reflector.

16. The method of claim 13, wherein the main reflector is a parabolic reflector.

17. The method of claim 13, wherein the first reflector is a flat plate reflector.

18. A method of transmitting an RF signal using a Dragonian antenna having a sub-reflector and a main reflector, comprising:

transmitting the RF signal from a source to a first reflector;

reflecting the RF signal from the first reflector to the sub-reflector;

reflecting the RF signal from the sub-reflector to the main reflector; and reflecting the RF signal from the main reflector to form a transmitted RF beam; and rotating the first reflector and the Dragonian antenna about an elevation axis passing through the first reflector to scan the transmitted RF beam in an elevation direction.

19. The method of claim 18, wherein the rotation is such that the transmitted RF beam is scanned through a hemispherical field of regard in the elevation direction.

20. The method of claim 18, wherein the sub-reflector is a hyperbolic sub-reflector.

21. The method of claim 18, wherein the main reflector is a parabolic reflector.

22. The method of claim 18, wherein the first reflector is a flat plate reflector.

* * * * *